US007669448B1

(12) United States Patent
Gharib

(10) Patent No.: US 7,669,448 B1
(45) Date of Patent: Mar. 2, 2010

(54) LOCKSEAMING PROCESS AND APPARATUS FOR SAME

(76) Inventor: Mohamed Gharib, 772 Saginaw Parkway, Cambridge, ON (CA) N1T 1V6

( * ) Notice: Subject to any disclaimer, the term of this patent is extended or adjusted under 35 U.S.C. 154(b) by 189 days.

(21) Appl. No.: 11/940,685

(22) Filed: Nov. 15, 2007

Related U.S. Application Data

(63) Continuation-in-part of application No. 11/184,952, filed on Jul. 20, 2005, now abandoned.

(51) Int. Cl.
*B21D 39/02* (2006.01)
*B21D 51/28* (2006.01)
*B21D 9/08* (2006.01)
*B21D 9/05* (2006.01)

(52) U.S. Cl. ..... 72/51; 72/213; 72/389.1; 72/394

(58) Field of Classification Search ..... 72/51, 72/52, 212–214, 389.1, 367.1, 368, 370.01, 72/390.4, 390.5, 394, 403, 407, 450
See application file for complete search history.

(56) References Cited

U.S. PATENT DOCUMENTS 3,802,239 A * 4/1974 Karmann et al. ..... 72/51
3,868,840 A 3/1975 Ekroos et al.
3,872,706 A 3/1975 Miller
4,513,596 A 4/1985 Usher
5,309,627 A * 5/1994 Burrage et al. ..... 29/738
6,000,115 A 12/1999 Takagi et al.
6,513,553 B2 2/2003 Lennartsson

* cited by examiner

*Primary Examiner*—Dana Ross
*Assistant Examiner*—Teresa M Bonk

(57) ABSTRACT

An apparatus for forming a thin wall sheet with first and second edge portions into a shell with a predetermined body configuration and a lockseam in which the edge portions are folded over each other. The apparatus includes a mandrel, a means for at least partially wrapping the sheet around the mandrel into the predetermined body configuration, and a number of gathering bars for engaging the sheet to configure the first and second edge portions according to a predetermined design. The apparatus also includes a number of forming bars for forming the first and second edge portions into respective preselected shapes extending above the top side of the mandrel, and a number of lockseaming rollers for folding the first and second edge portions over each other to form the lockseam.

2 Claims, 17 Drawing Sheets

LOCKSEAMING PROCESS AND APPARATUS FOR SAME

This application is a continuation-in-part application of application Ser. No. 11/184,952, filed on Jul. 20, 2005.

FIELD OF THE INVENTION

This invention is related to a method for forming a thin wall sheet into a shell with a predetermined body configuration and a lockseam, and an apparatus for same.

BACKGROUND OF THE INVENTION

Silencer shells (mufflers) and other types of housings such as those used in the automotive industry are formed by wrapping a relatively thin wall sheet around a mandrel that has the same shape as the desired silencer (muffler) shell, then mechanically locking the two sheet edges of the sheet together using a process called lockseaming. The sheet is usually made of galvanized or otherwise corrosion-resistant steel, as is known in the art.

The lockseaming process of the prior art involves the use, first, of gathering rollers, and second, of lockseaming rollers. In the prior art (described further below), after the sheet has been wrapped onto the mandrel, the gathering rollers are passed over the sheet on the mandrel, i.e., from a leading side of the sheet to a trailing side thereof. Subsequently, the lockseaming rollers are passed over the sheet on the mandrel in the same direction, i.e., from the leading side to the trailing side. As will be described, however, the prior art process results in drag on the sheet. Such drag forces sheet material away from the vertical center plane of the mandrel, especially toward the trailing side, and tends to cause edge portions of the sheet towards the trailing side of the sheet to be further apart than desired. As a result, the lockseam in the portion of the lockseamed shell towards the trailing side tends to be of lower quality.

The prior art technique for forming thin wall sheet into an automotive muffler shell 62 will now be described, with reference to FIGS. 1, 2, 3A, 3B, 4A, 4B, 5A, 5B, 6, 7A, 7B, 7C, 7D, 7E, 8 and 9. (As will be described, the remainder of the drawings illustrate the present invention.) The forming technique according to the prior art includes, first, providing a mandrel 1 that is shaped so as to form a muffler shell in accordance with a predetermined design (FIG. 1). As is known, the muffler shell may have any of a variety of shapes, i.e., it may be round, oval, or irregular in cross-section.

In the prior art, a thin wall sheet 2 is placed under the mandrel 1 and above forming rollers 3, 4 and a pressure bar 12 (FIG. 1). The rollers 3, 4 are mounted on arms 5, 6. The arms 5, 6 are mounted for rotation around centers 7, 8 which are mounted on a platform 11. Springs 9, 10 urge the arms 5, 6 against the mandrel 1, i.e., in the directions indicated by arrows "A" and "B" (FIG. 2).

The pressure bar 12 preferably is mounted on a pneumatic cylinder 13. As shown in FIG. 1, at the beginning of the prior art process, the pressure bar 12 is spaced apart from the mandrel 1 sufficiently to permit the sheet 2 to be positioned between the pressure bar 12 and the mandrel 1. After the sheet 2 has been positioned as shown in FIG. 1, the pressure bar 12 and the platform 11 move relative to the mandrel 1 in the direction indicated by arrow "C" in FIG. 1 to result in the sheet 2 being pressed tightly against the mandrel 1 by the pressure bar 12 at a point where a lowest part of the mandrel surface is intersected by the vertical center plane 58 of the mandrel, as shown in FIG. 2.

Preferably, the platform 11 is moved up and down by one or more hydraulic cylinders 13, however, the movement may be effected by any suitable means. As the platform 11 moves up (i.e., in the direction indicated by arrow "C"), the forming rollers 3, 4 along with the arms 5, 6 are rotated around the centers 7 and 8 and the springs 9, 10 urge the rollers 3, 4 against the sheet 2, pressing the sheet 2 against the mandrel 1, so that the sheet 2 is partially formed around the mandrel 1 as shown in FIG. 2.

As can be seen in FIGS. 2 and 3, the pressure bar 12 holds a portion of the sheet 2 firmly against the mandrel 1 so that the sheet 2 does not move in a horizontal plane relative to the mandrel 1 while the platform 11 is moving upward and the rollers 3 and 4 are forming the sheet 2 around the mandrel 1.

The prior art process and apparatus described herein disclose only one of the common methods of the prior art. Other means of forming the sheet 2 around the mandrel 1 are known to those who are skilled in the art.

Typically, the mandrel is stationary, and a roll carriage 14 (FIG. 6) is adapted to move relative to the mandrel 1. Various means for mounting and moving the prior art roll carriage 14 relative to the mandrel 1 are well known to those skilled in the art. In the prior art, the roll carriage 14 includes gathering rollers 15, 16 and vertical rollers 17 which are mounted so as to engage the sheet 2 after the sheet 2 has been generally positioned on the mandrel 1 by the forming rollers, as shown in FIG. 2.

The gathering rollers 15, 16 and the vertical rollers are allowed to travel on top of the mandrel 1 and substantially symmetrically about the center plane 58 of the mandrel 1 so that two edge portions 39, 40 (FIG. 3B) of the sheet 2 are gathered together by the gathering rollers 15, 16 and formed against the vertical roller set 17.

As the roll carriage 14 travels along the center plane 58 of the mandrel 1, the gathering rollers 15, 16 progressively push the edge portions 39, 40 closer together, as shown in FIGS. 4A, 4B.

The roll carriage 14 (FIG. 6) typically also includes lockseaming rollers 18, 19, which are mounted so that the lockseaming rollers 18, 19 engage the edge portions 39, 40 (FIGS. 5A, 5B) after the sets of gathering rollers 15, 16 and the vertical roller 17 have done so. As is well known in the art, each of the sets of rollers 15, 16, 17, 18, 19 consists of a number of rollers of different shapes which are arranged so that they progressively form the two edge portions 39, 40 into a lockseam 41 (FIG. 7A).

The ideal form of lockseam 41 is shown in FIG. 7A. As can be seen in FIG. 7A, in the ideal form of lockseam, the edge portions 39, 40 are folded over into each other to provide a secure seam, as is known.

In the prior art, the number of rollers in the sets of gathering rollers 15, 16 varies depending on a number of factors, such as design and preference. Typically, each set of gathering rollers 15, 16 includes seven to nine rollers. Similarly, the number of rollers in the set of rollers 17 varies depending on design and preference. Typically, three rollers are included in the set of rollers 17.

Also, the number of rollers in the sets of lockseaming rollers 18,19 varies depending on design and preference. Typically design includes seven to nine rollers in each of the sets of rollers 18, 19.

Many variations to the prior art arrangements described above are known to those skilled in the art. For example, the springs 9 and 10 may be replaced by hydraulic or pneumatic cylinders or any other suitable means for urging the forming rollers against the mandrel 1.

As indicated above, the roll carriage 14 (i.e., including the gathering roller sets 15, 16, the vertical roller set 17, and the lockseaming roller sets 18, 19) travels in a path substantially along the vertical center plane 58 of the mandrel 1, in which an axis of the mandrel lies. The various roller sets engage the sheet on the mandrel respectively, as the roll carriage 14 moves relative to the mandrel 1. The gathering rollers 15 progressively bring the edge portions 39, 40 together and form the edge portions 39, 40 over the vertical roller set 17. Furthermore, in ideal conditions (i.e., when the edge portions 39, 40 are sufficiently large to be formed into an acceptable lockseam (see, e.g., FIG. 7A)), the lockseaming rollers 18, 19 progressively form the two edge portions 39, 40 into the ideal lockseam 41 as shown in FIG. 7A.

However, in practice, conditions often are not ideal. The process of gathering the edge portions 39, 40 together (i.e., when the gathering rollers 15 are moved along the edge portions 39, 40 and engage the edge portions 39, 40) causes "drag" on the sheet 2, tending to cause the edge portions 39, 40 to be spaced progressively further apart. The edge portions 39, 40 tend to be spaced further apart due to drag the closer they are to the trailing side of the sheet. For illustrative purposes, FIGS. 7A-7C show the finished shell 62 with the ideal lockseam 41 (FIG. 7A) at the leading side (i.e., to the left as presented in FIG. 7C), as viewed by an observer viewing the shell from the leading side, and an inadequate lockseam 63 (FIG. 7B) at the trailing side (i.e., to the right as presented in FIG. 7C), as viewed by an observer viewing the shell from the trailing side. FIGS. 7D and 7E are end views of the shell 62 after removal thereof from the mandrel 1.

Drag is exacerbated when forming somewhat larger muffler cross-sections such as relatively large, round mufflers and asymmetric shapes, for example, as illustrated in FIG. 8.

As can be seen in FIG. 8, when the shell is larger, the forming rollers 3 and 4 are placed at somewhat greater distances from the gathering rollers 15, 16, and also from the lockseaming rollers 18, 19. Because of this, sections 42, 43 of the sheet 2 are not maintained firmly pressed against the mandrel 1 between the gathering and lockseaming rollers 15,16, 17, 18, and 19 and the forming rollers 3, 4. The drag on the muffler sheet edge portions 39, 40 forces the sheet material downwardly into the areas 42, 43. This tends to be more pronounced toward the trailing side of the sheet. Because of this, it sometimes happens that insufficient material for lockseaming is present in the edge portions 39, 40 resulting in deterioration of the lockseam 41 towards the trailing side. A typical defective lockseam (i.e., due to insufficient material in the edge portions 39, 40 toward the trailing side) is shown in FIG. 7B. Also, if the edge portions 39, 40 deviate sufficiently from design requirements, then the lockseam may not be formed at all.

As noted above, FIG. 8 shows that, where the shell to be formed is larger, the forming rollers 3, 4 are positioned, at their highest positions, relatively far from the gathering rollers 15, 16 and the lockseaming rollers 18, 19. This tends to result in drag. FIG. 9 shows the typical consequence of positioning the forming rollers 3 and 4 (at their highest positions) closer to the top of the mandrel, in order to address the problem illustrated in FIG. 8. However, and as shown in FIG. 9, positioning the forming rollers higher causes a different problem. By forming a larger section of the sheet 2 around the mandrel 1 as shown in FIG. 9, the forming rollers 3, 4 are closer to the gathering rollers 15,16 and 17 and the lockseaming rollers 18, 19. However, the sheet edge portions 39, 40 are folded over each other (FIG. 9) because of the relatively high positioning of the forming rollers 3, 4. In this situation, the vertical roller set 17 (not shown in FIG. 9) is unable to separate the two sheet edge portions 39, 40 and to provide them in the required (separated) position so that they can be engaged by the gathering rollers and, subsequently, the lockseaming rollers. Accordingly, the required lockseam cannot be formed when the prior art conditions shown in FIG. 9 are present.

Therefore, there is a need for an improved lockseaming process and apparatus.

SUMMARY OF THE INVENTION

In its broad aspect, the invention provides an apparatus for forming a thin wall sheet with first and second edge portions into a shell with a predetermined body configuration and a lockseam in which the first and second edge portions are folded over each other. The apparatus includes a mandrel extending between leading and trailing ends thereof, the mandrel being shaped to at least partially form the sheet into the predetermined body configuration, and a means for at least partially wrapping the sheet around the mandrel into the predetermined body configuration. When the sheet is at least partially wrapped around the mandrel, a leading side of the sheet is positioned adjacent to the leading end of the mandrel, a trailing side of the sheet is positioned adjacent to the trailing end of the mandrel, and the first and second edge portions are positioned proximal to each other adjacent to an uppermost top side of the mandrel. The apparatus also includes a number of gathering bars for engaging the sheet to configure the first and second edge portions according to a predetermined design, and a number of forming bars for forming the first and second edge portions into respective preselected shapes extending above the top side of the mandrel. In addition, the apparatus includes a number of lockseaming rollers for folding the first and second edge portions over each other to form the lockseam.

In another aspect, the invention provides a center bar having first and second engagement surfaces adapted to cooperate with the forming bars to form the first and second edge portions respectively into the preselected shapes adapted for engagement by the lockseaming rollers to form the lockseam.

In yet another of its aspects, the invention provides an apparatus for forming a thin wall sheet with first and second edge portions into a shell with a predetermined body configuration and a lockseam in which the first and second edge portions are folded over each other. The apparatus includes a mandrel extending between leading and trailing ends thereof, the mandrel being shaped to at least partially form the sheet into the predetermined body configuration, and a means for at least partially wrapping the sheet around the mandrel into the predetermined body configuration so that a leading side of the sheet is positioned adjacent to the leading end of the mandrel, a trailing side of the sheet is positioned adjacent to the trailing end of the mandrel, and the first and second edge portions are positioned proximal to each other adjacent to an uppermost top side of the mandrel. The apparatus also includes a number of gathering bars for engaging the sheet to configure the first and second edge portions according to a predetermined design.

In another of its aspects, the invention provides a method of forming a thin wall sheet into a shell with a predetermined body configuration and a lockseam. The method includes, first, wrapping the sheet at least partially around a mandrel to provide a partially formed shell body extending between leading and trailing sides of the sheet. Next, the sheet is engaged with a number of gathering bars to configure the first and second edge portions of the sheet according to a predetermined design. Third, the first and second edge portions are then formed with a number of forming bars to form the first and second edge portions into respective preselected shapes extending above the top side of the mandrel. Finally, the first and second edge portions are engaged with a number of lockseaming rollers to fold the first and second edge portions over each other to form the lockseam.

DETAILED DESCRIPTION

To simplify the description, the numerals used previously in describing FIGS. 1-9 will be used again after raising the respective numerals by 100 where the parts to be described correspond to parts already described.

Figure 1:
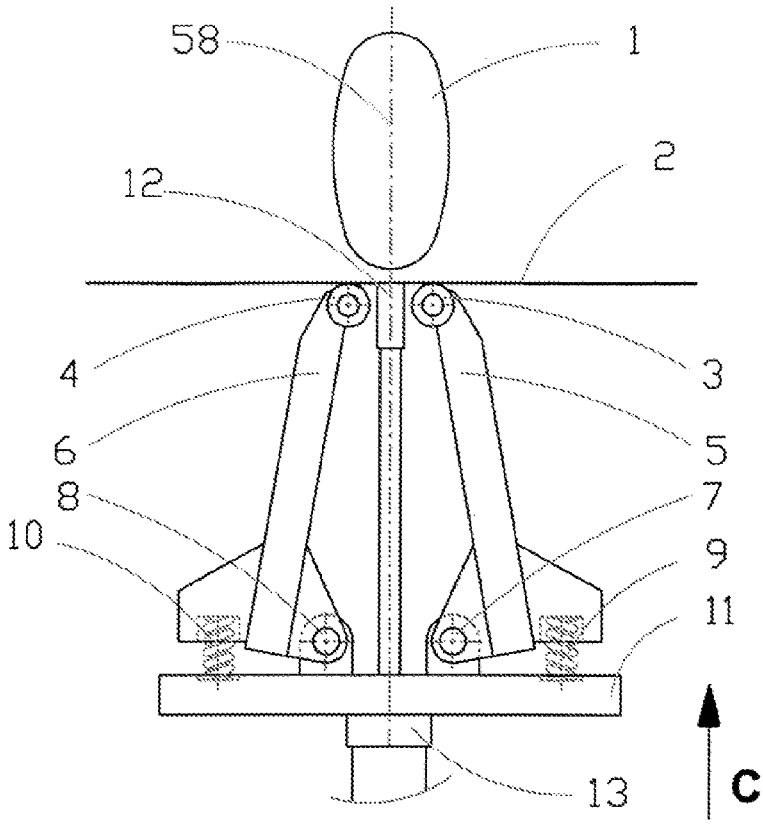
Fig. 1 (Prior Art)
FIG. 1 (also described previously) is a cross-section of a lockseaming apparatus of the prior art in which a thin wall sheet is in position to be at least partially wrapped around a mandrel.
Figure 2:
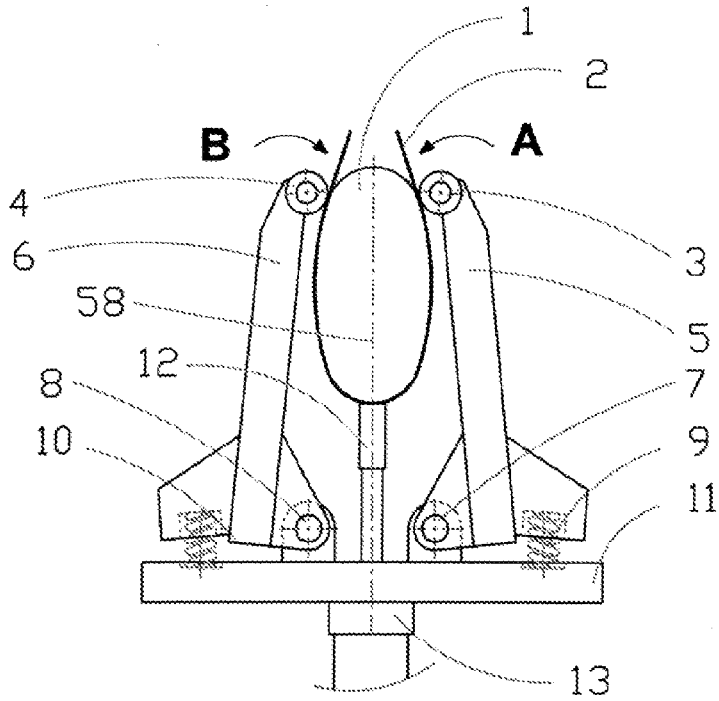
Fig. 2 (Prior Art)
FIG. 2 (also described previously) is a cross-section of the lockseaming apparatus of FIG. 1 showing forming rollers in the up position with the sheet partially wrapped around a mandrel.
Figure 3B:
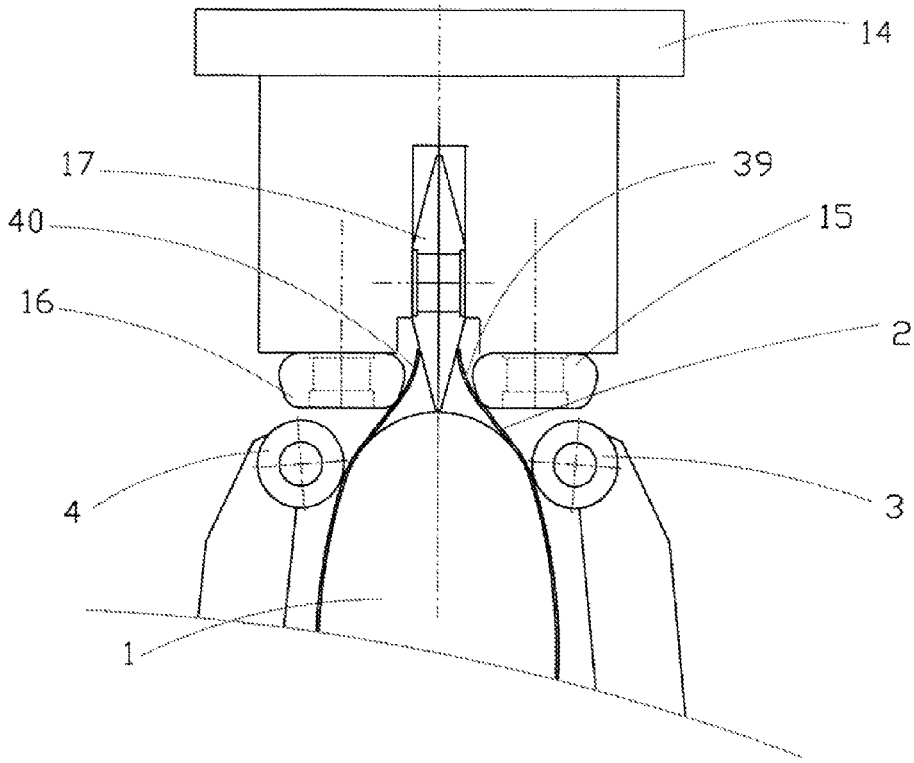
Fig. 3B (Prior Art)
FIG. 3B (also described previously) is a cross-section of a portion of the lockseaming apparatus of FIG. 3A, drawn at a larger scale.
Figure 3A:
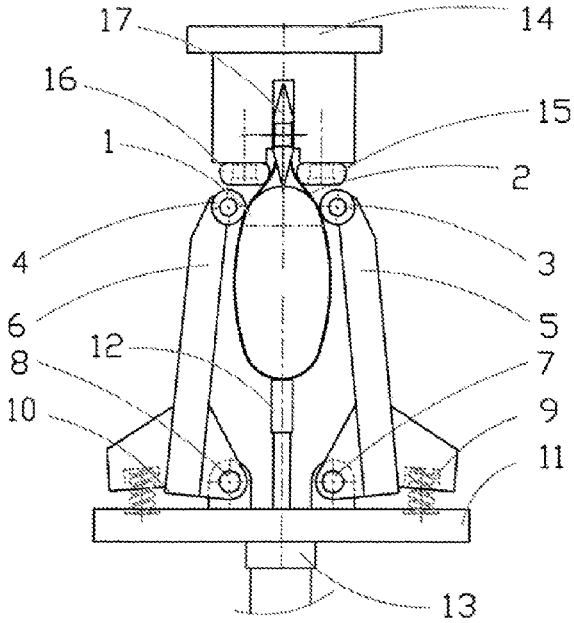
Fig. 3A (Prior Art)
FIG. 3A (also described previously) is a cross-section of the lockseaming apparatus of FIG. 1 showing gathering rollers pre-forming two sheet edge portions.
Figure 4B:
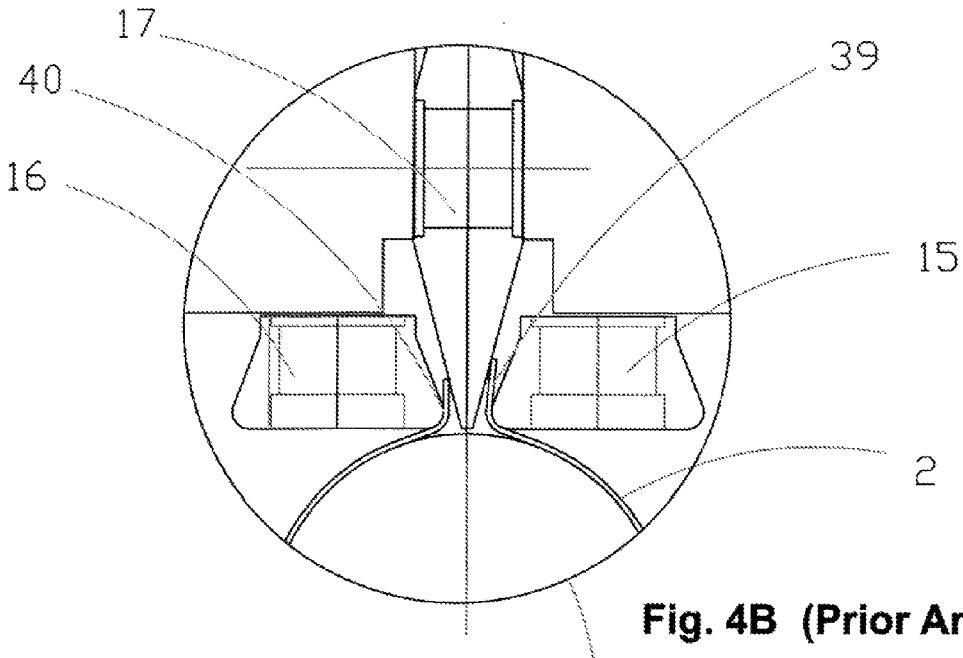
Fig. 4B (Prior Art)
FIG. 4B (also described previously) is a cross-section of a portion of the lockseaming apparatus of FIG. 4A, drawn at a larger scale.
Figure 4A:
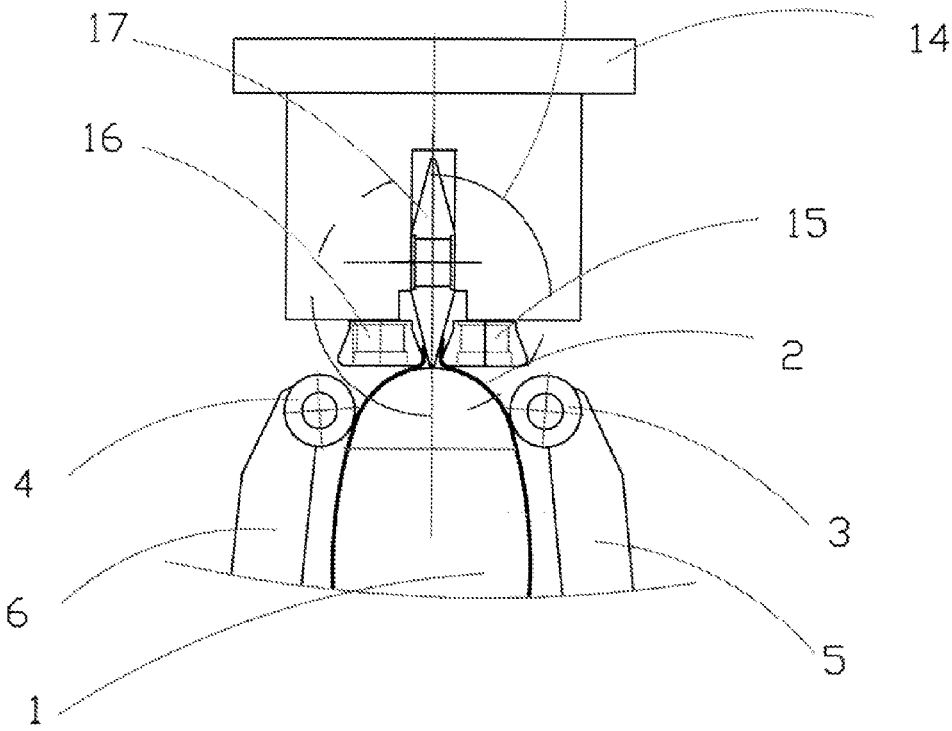
Fig. 4A (Prior Art)
FIG. 4A (also described previously) is a cross-section of the lockseaming apparatus of FIG. 1 showing gathering rollers engaged in the pre-forming process, drawn at a smaller scale.
Figure 5B:
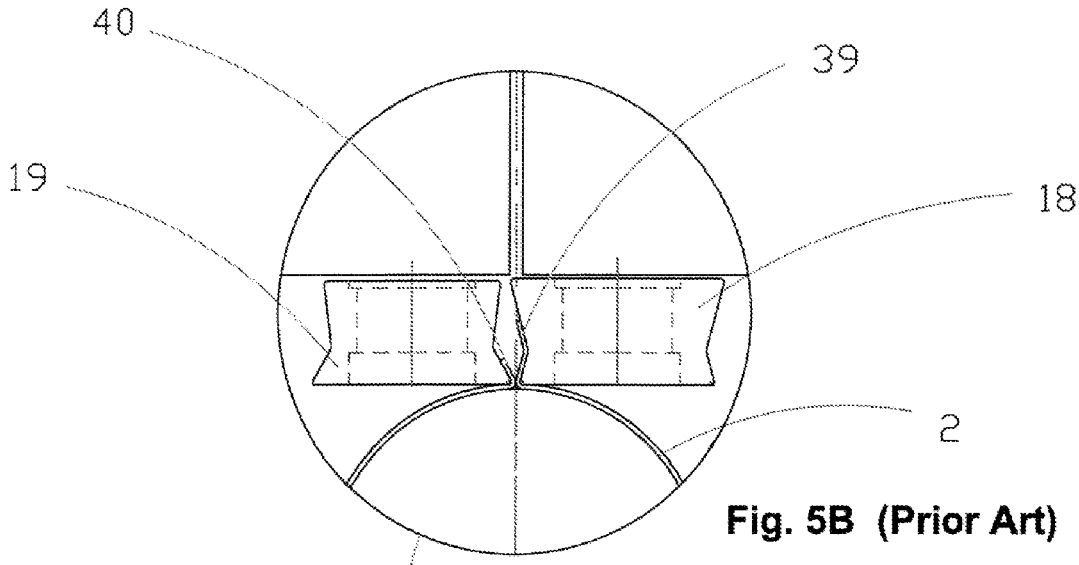
Fig. 5B (Prior Art)
FIG. 5B (also described previously) is a cross-section of a portion of the lockseaming apparatus of FIG. 5A, drawn at a larger scale.
Figure 5A:
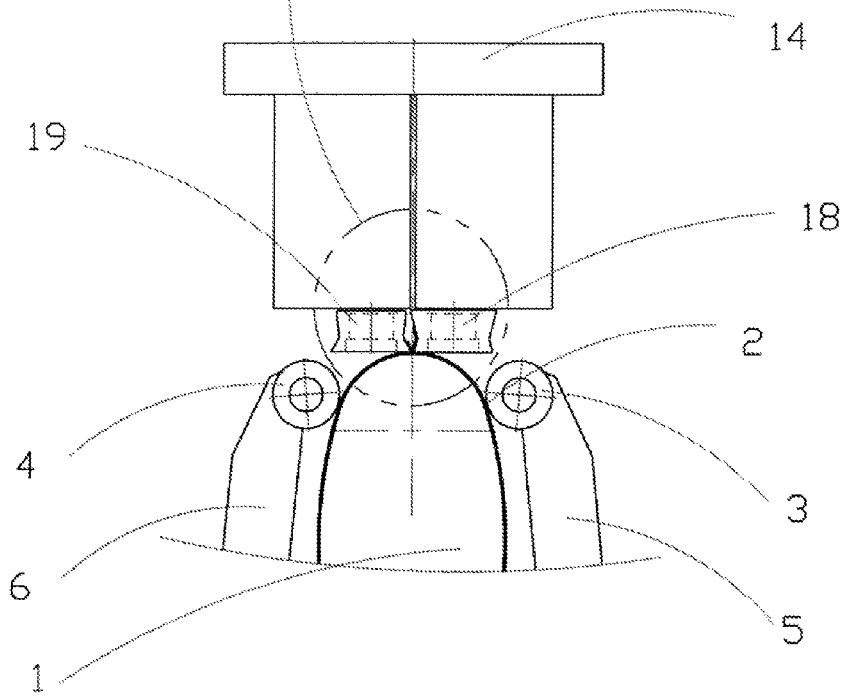
Fig. 5A (Prior Art)
FIG. 5A (also described previously) is a cross-section of the lockseaming apparatus of FIG. 1 showing lockseaming rollers engaged in lockseaming two edge portions of the sheet, drawn at a smaller scale.
Figure 6:
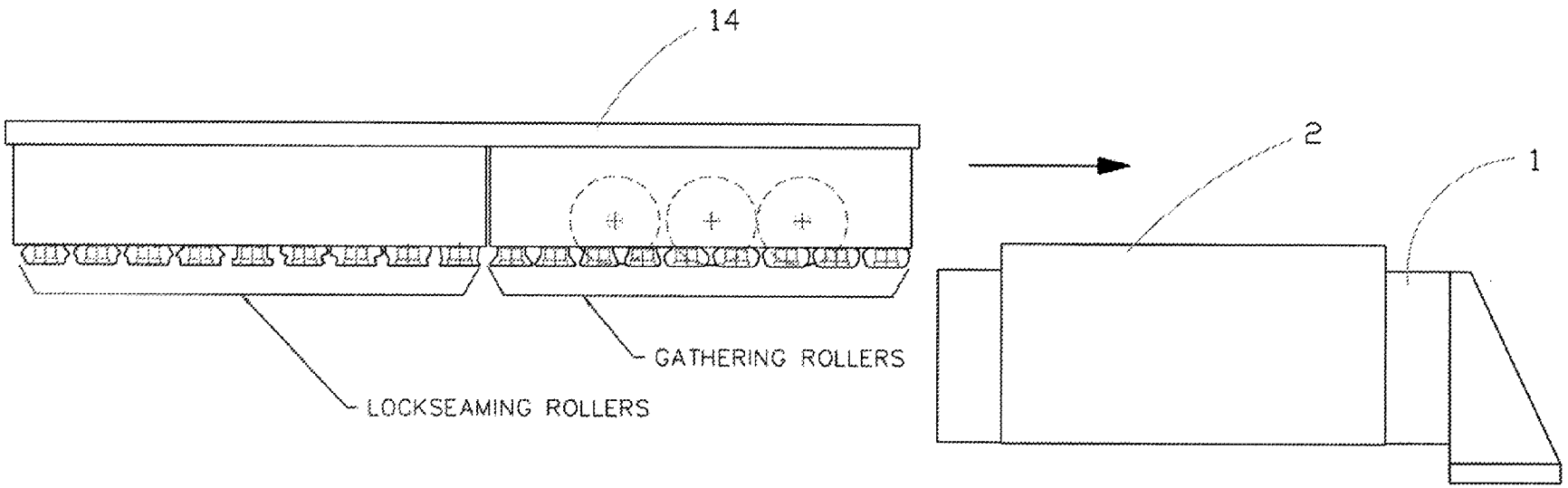
Fig. 6 (Prior Art)
FIG. 6 (also described previously) is a side view of a typical roll carriage of the prior art in position to move past the mandrel of FIG. 1 with the sheet partially formed on the mandrel, drawn at a smaller scale.
Figures 7A, 7B, 7C, 7D, 7E:
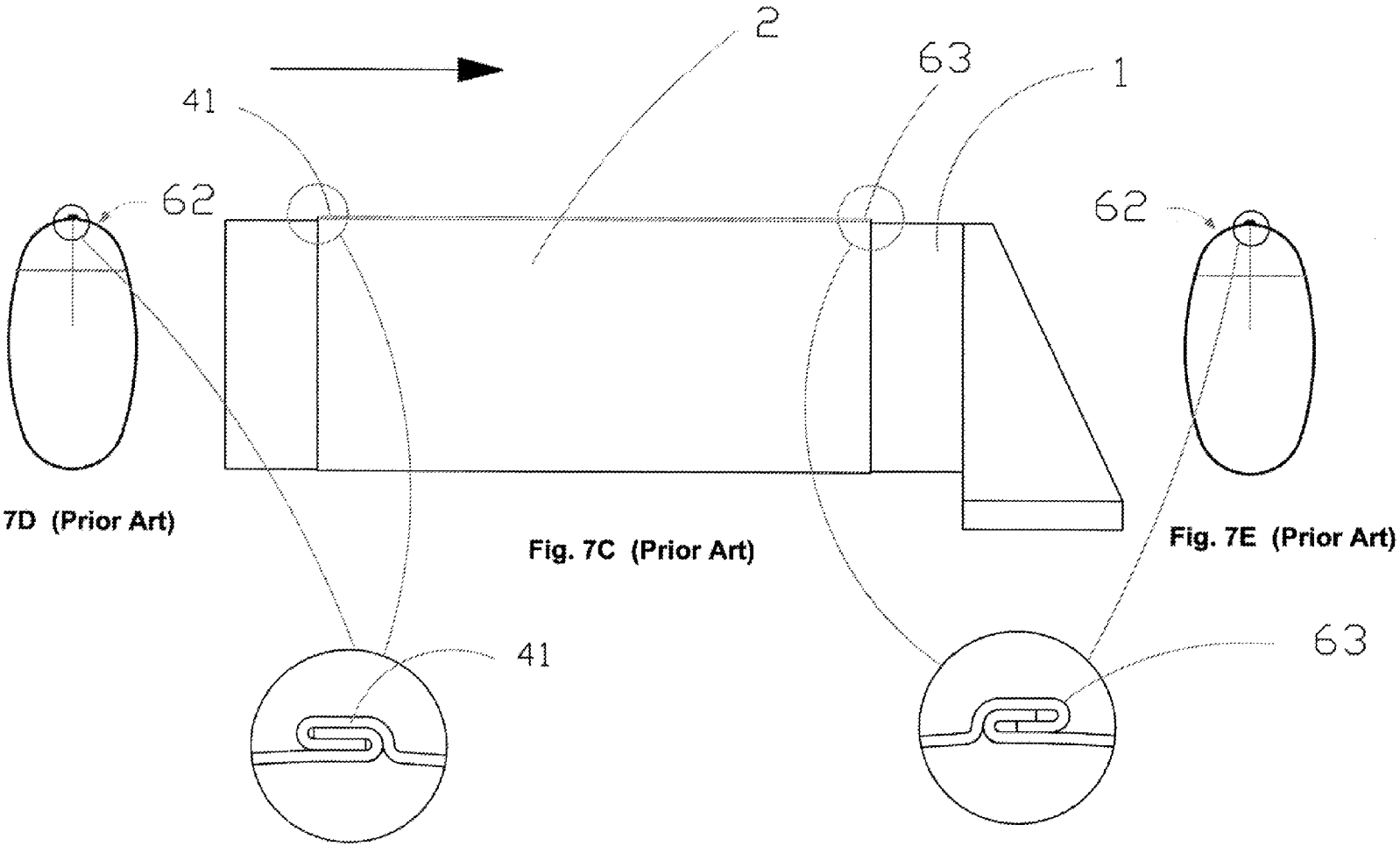
Fig. 7A (Prior Art)
Fig. 7B (Prior Art)
Fig. 7C (Prior Art)
Fig. 7D (Prior Art)
Fig. 7E (Prior Art)
FIG. 7A (also described previously) is a cross-section of a finished lockseam in ideal form, drawn at a larger scale.
FIG. 7B (also described previously) is a cross-section of a defective lockseam of the prior art.
FIG. 7C (also described previously) is a longitudinal side view of the mandrel of FIG. 6 with the sheet thereon formed into a shell with the lockseam, drawn at a smaller scale.
FIG. 7D is an end view of the shell of FIG. 7C at the leading end thereof, drawn at a smaller scale.
FIG. 7E is an end view of the shell of FIG. 7C at the trailing end thereof.
Figure 8:
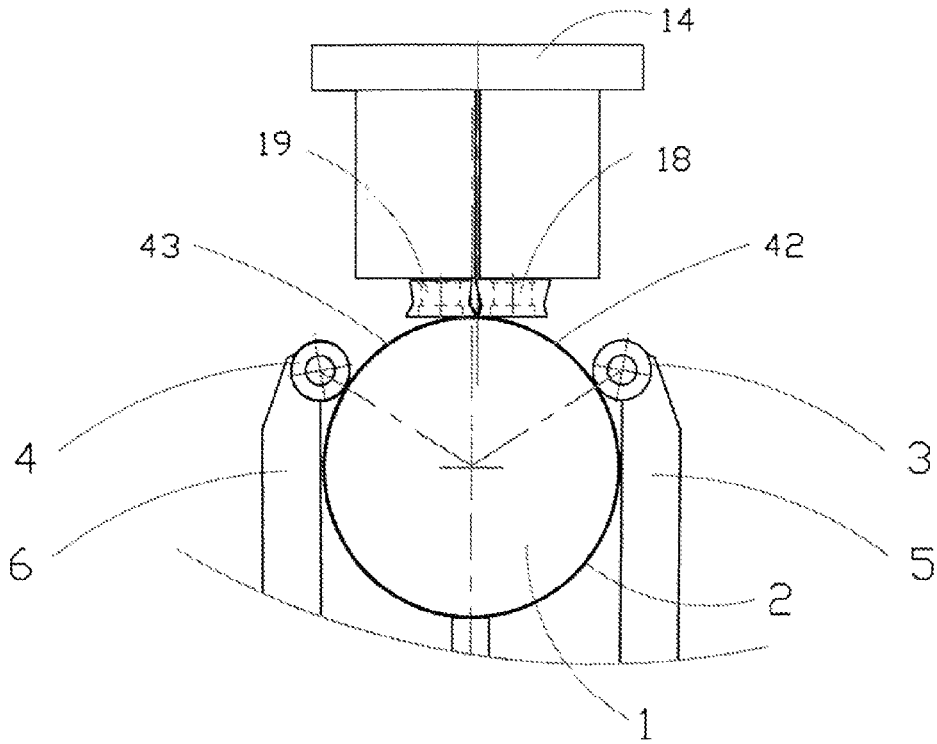
Fig. 8 (Prior Art)
FIG. 8 (also described previously) is a cross-section of another lockseaming apparatus of the prior art, drawn at a larger scale.
Figure 9:
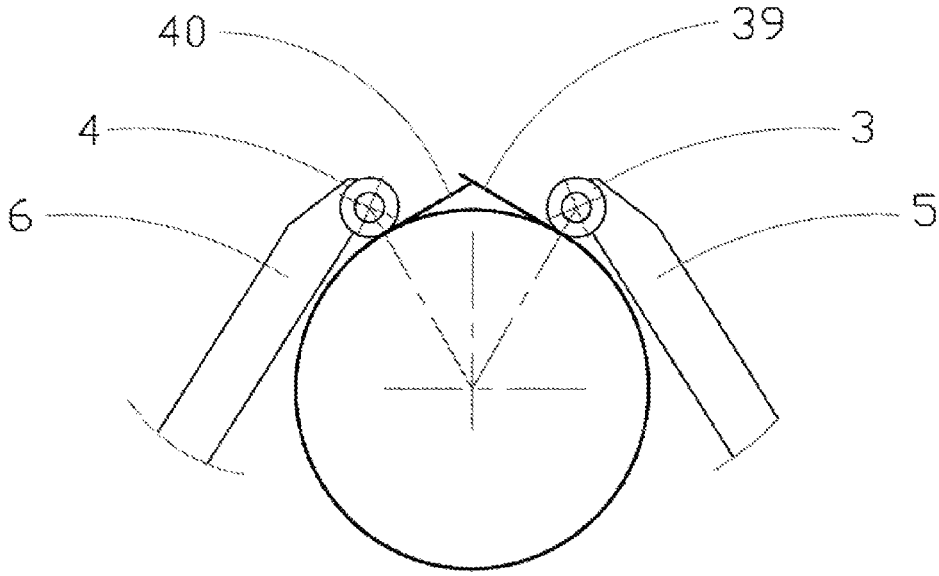
Fig. 9 (Prior Art)
FIG. 9 (also described previously) is a cross-section of a portion of the lockseaming apparatus of FIG. 8 showing forming rollers in relatively higher positions, drawn at a larger scale.
Figures 10A, 10B:
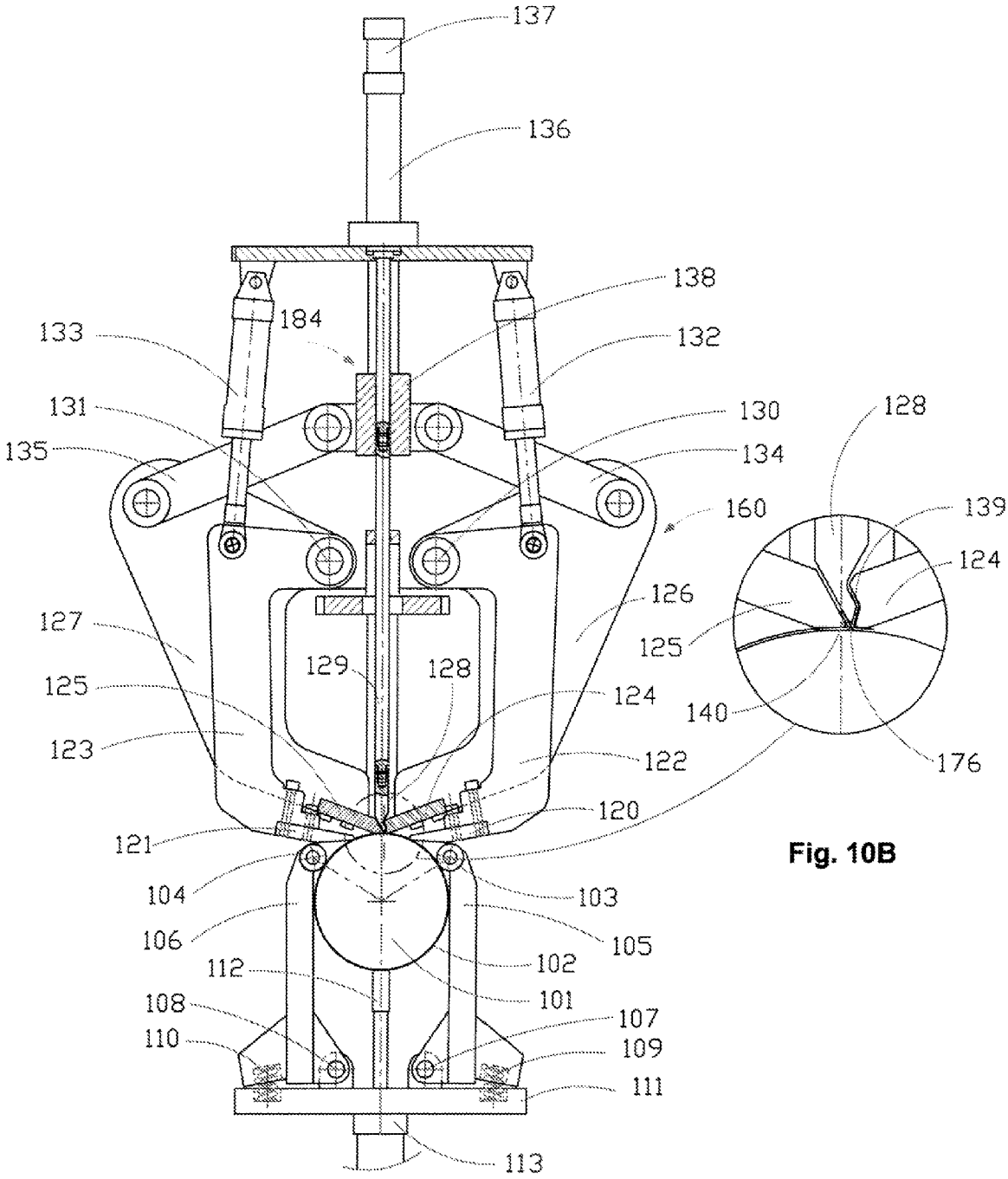
FIG. 10A is a cross-section of an embodiment of an apparatus of the invention, drawn at a smaller scale.
FIG. 10B is a cross-section of a portion of the apparatus of FIG. 10A showing first and second edge portions of the sheet formed between forming bars and a center bar, drawn at a larger scale.
Figure 10C:
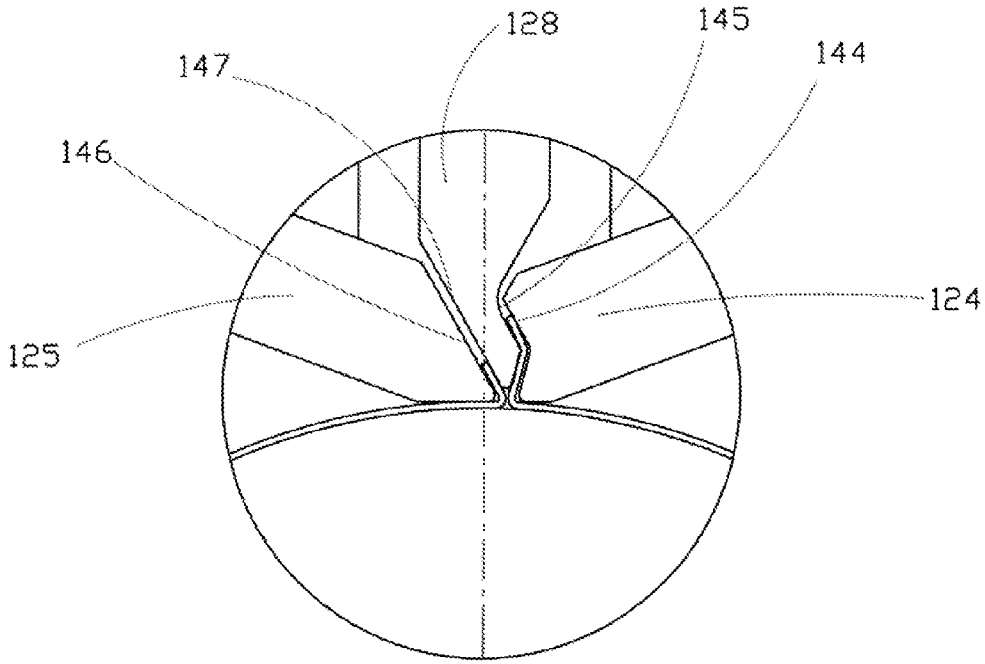
FIG. 10C is a cross-section of the portion shown in FIG. 10B, drawn at a larger scale.
Figure 16B:
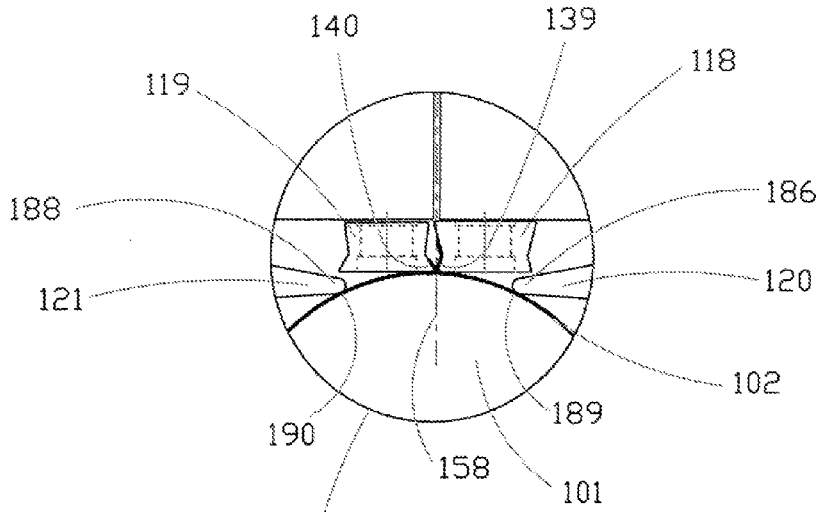
FIG. 16B is a cross-section of a portion of the apparatus of FIG. 16A, drawn at a larger scale.
Figure 16A:
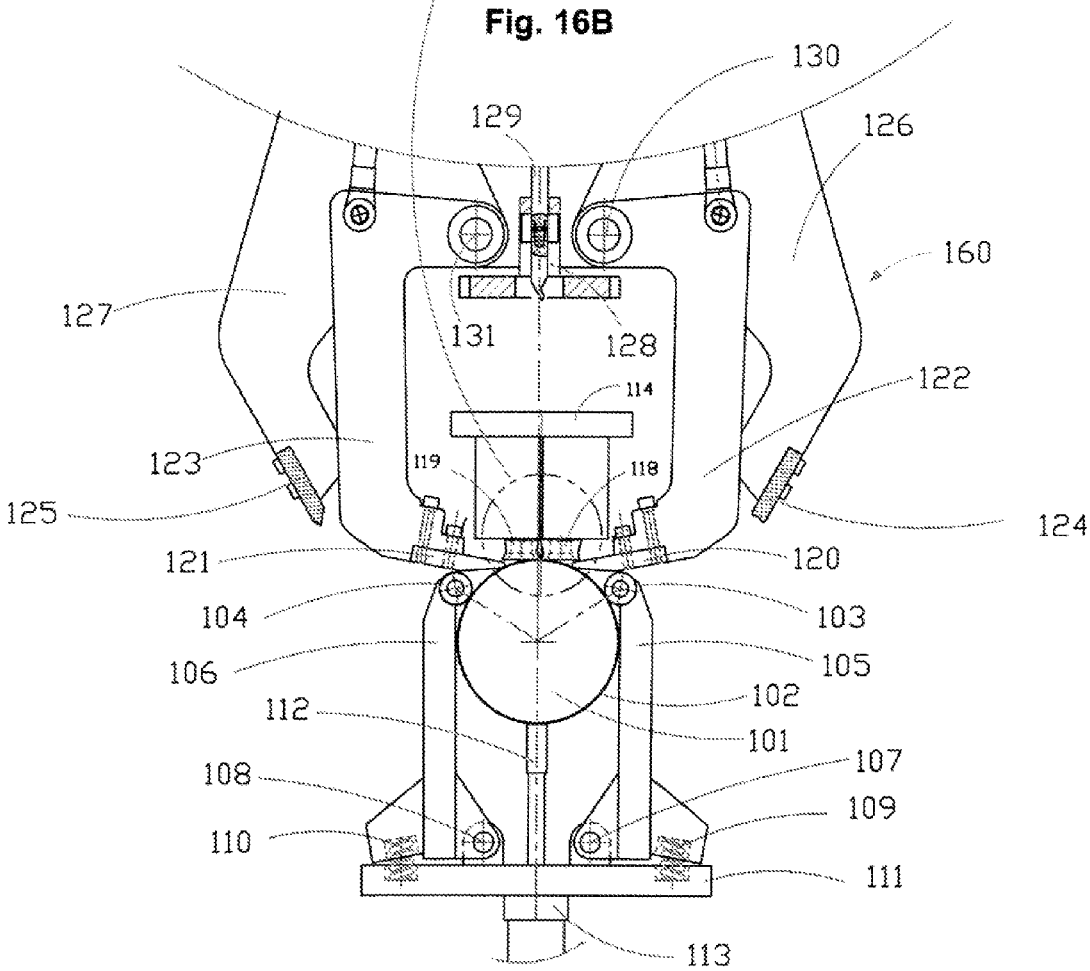
FIG. 16A is a cross-section of the apparatus of FIG. 10A showing the lockseaming rollers engaging the edge portions to form the lockseam, drawn at a smaller scale.
Figure 17:
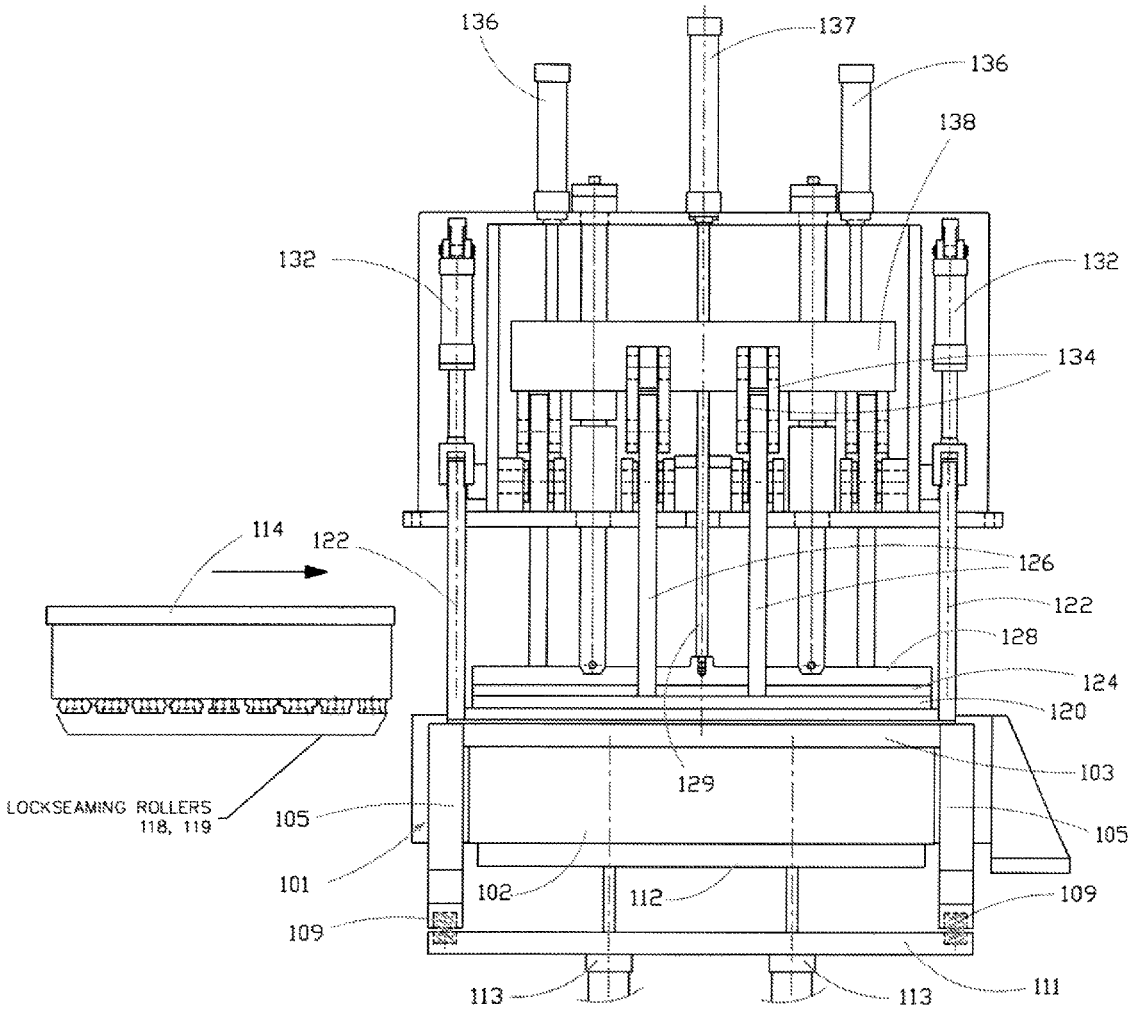
FIG. 17 is a side view of the apparatus of FIG. 10A.
Figures 18A, 18B, 18C:
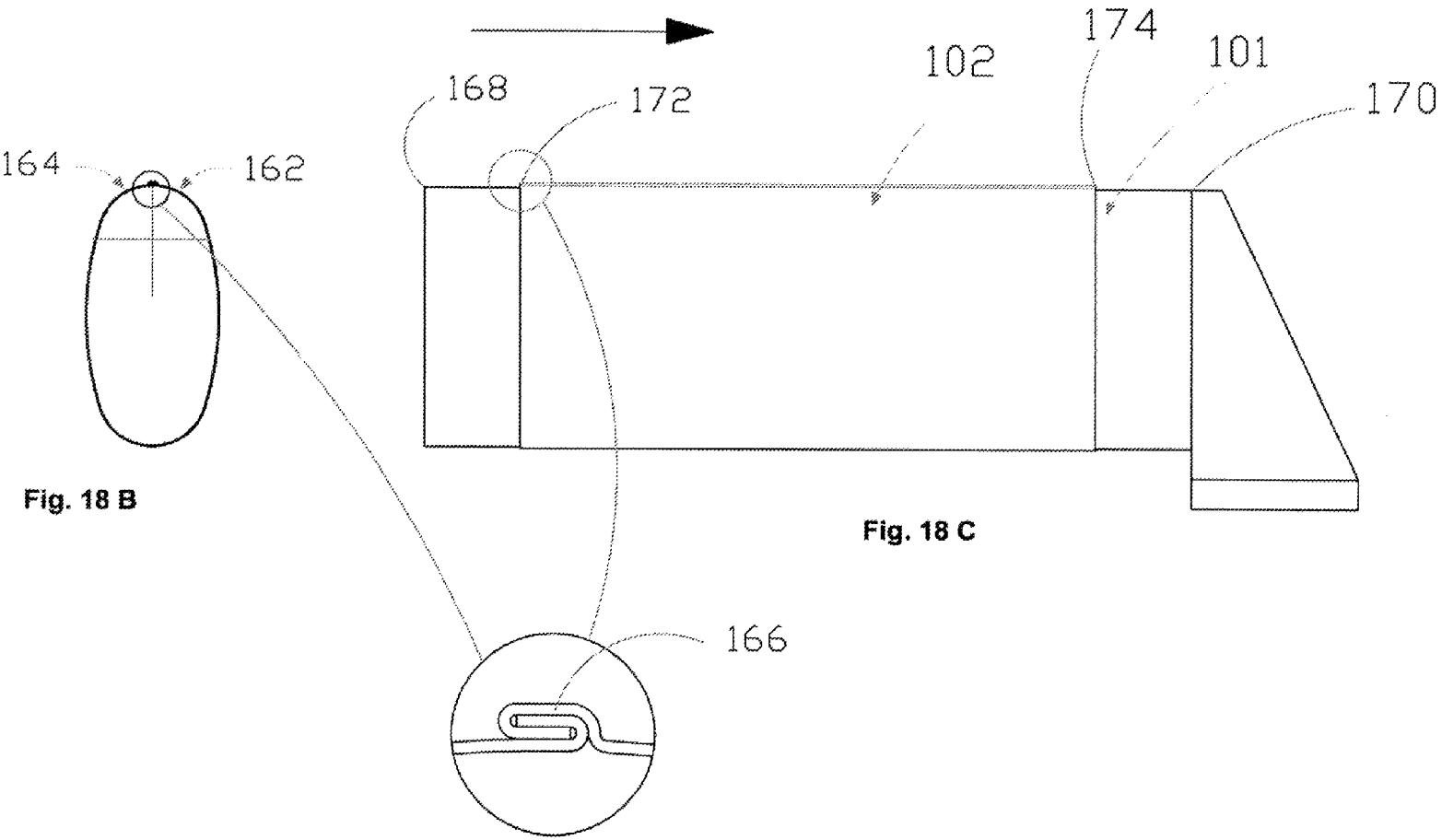
FIG. 18A is a cross-section of a finished lockseam formed (at least partially) by the apparatus of FIG. 10A, drawn at a smaller scale.
FIG. 18B is an end view of a shell formed (at least partially) by the apparatus of FIG. 10A, drawn at a small scale.
FIG. 18C is a longitudinal side view of the mandrel of FIG. 17 with the sheet thereon formed into a shell.

Reference is first made to FIGS. 10A, 10B, 10C, 17, and 18C to describe an embodiment of the apparatus in accordance with the invention indicated generally by the numeral 160. The apparatus 160 is for forming a thin wall sheet 102 including first and second edge portions 139, 140 into a shell 162 (FIG. 18) with a predetermined body configuration 164 (FIG. 18B) and a lockseam 166 (FIG. 18A) in which the first and second edge portions 139, 140 are folded over each other. The apparatus 160 includes a mandrel 101 extending between leading and trailing ends 168, 170 (FIGS. 17, 18C). The mandrel 101 is shaped to at least partially form the sheet 102 into the predetermined body configuration 164. The apparatus 160 also includes means 103, 104 adapted to at least partially wrap the sheet 102 around the mandrel 101 into the predetermined body configuration 164 so that a leading side 172 of the sheet 102 is positioned adjacent to the leading end 168 of the mandrel 101 and a trailing side 174 of the sheet 102 is position adjacent to the trailing end 170 of the mandrel 101. Preferably, the means 103, 104 are forming rollers. Also, the first and second edge portions 139, 140 are positioned proximal to each other adjacent to an uppermost top side 176 of the mandrel 101 (FIGS. 10B, 10C). Preferably, the apparatus 160 also includes a number of gathering bars 120, 121 for engaging the sheet 102 to configure the first and second edge portions 139, 140 according to a predetermined design, as will be described. It is also preferred that the apparatus 160 includes a number of forming bars 124, 125 for forming the first and second edge portions 139, 140 into preselected shapes extending above the top side 176 of the mandrel 101 by preselected distances, as will also be described. Preferably, the apparatus 160 also includes a number of lockseaming rollers 118, 119 (FIGS. 16A, 16B) for folding the first and second edge portions 139, 140 over each other to form the lockseam 166 (FIG. 18A).

In one embodiment, the apparatus 160 also includes a center bar 128 having first and second engagement surfaces 145, 147 adapted to cooperate with the forming bars 124, 125 to form the first and second edge portions 139, 140 respectively into the pre-selected shapes adapted for engagement by the lockseaming rollers 118, 119 to form the lockseam 166 (FIGS. 10B, 10C).

As can be seen in FIGS. 10A, 11, 12, 13A, 14A, 15A, 16A, and 17, in one embodiment, the gathering bars 120, 121 preferably are mounted on arms 122, 123 respectively. Preferably, the arms 122, 123 are pivotable about axes 130, 131 respectively. It is also preferred that the apparatus 160 includes cylinders 132, 133 operably connected to the arms 122, 123 respectively, for moving the gathering bars 120, 121 (and the arms 122, 123 on which they are mounted respectively) between an open position (FIGS. 11, 12), in which the gathering bars 120, 121 are disengaged from the sheet 102 on the mandrel 101, and a closed position (FIGS. 10A, 13A), in which the gathering bars 120, 121 are engaged with the edge portions 139, 140.

Preferably, the forming bars 124, 125 are mounted on arms 126, 127 respectively. The arms 126, 127 preferably are also pivotable about the axes 130, 131 respectively. In one embodiment, the arms 126, 127 are operably connected with toggle arms 134, 135, which are also operably connected with a slide 138. The toggle arms 134, 135 and the slide 138 comprise a toggle joint 184 (FIG. 10A). Preferably, the toggle joint 184 is operably connected with a cylinder 136 which, upon activation thereof, causes the arms 126, 127 to move between an open position, in which the forming bars 124, 125 are disengaged from the sheet 102 on the mandrel 101 (FIGS. 11, 12, 13A), and a closed position (FIGS. 10A, 14A), in which the forming bars 124, 125 engage the edge portions 139, 140.

It will be understood that the arms 122, 123 and 126, 127 may pivot about the same axes (e.g., axes 130, 131, as shown), or the two sets of arms (122, 123 and 126, 127) may alternatively pivot about different axes respectively. In addition, although movement is transmitted to the arms 126, 127 via the toggle joint 184 in one embodiment, the cylinder 136 may alternatively be operatively connected directly to the arms 126, 127 (not shown). Other arrangements for mounting the gathering bars and the forming bars will occur to those skilled in the art.

As described above, it is also preferred that the apparatus 160 includes the center bar 128, which, in one embodiment, is mounted on one or more rods 129 operably connected to one or more cylinders 137. The center bar 128 is movable, by the cylinder 137, between a raised position, in which the center bar 128 is distal to the mandrel 101 (FIG. 15A, 16A), and a lowered position, in which the center bar 128 is proximal to the mandrel 101 (for example, as shown in FIGS. 10A, 10B, and 10C). It is preferred that the center bar 128 includes first and second engagement surfaces 145, 147 (FIG. 10C). Preferably, the forming bar 124 includes a surface 144 that cooperates with the first engagement surface 145 of the center bar 128 to form the first edge portion 139 into a predetermined shape therefor (FIG. 10C). Similarly, the forming bar 125 includes a surface 146 which cooperates with the second engagement surface 147 of the center bar 128 to provide the second edge portion 140 with its predetermined shape.

Figure 11:
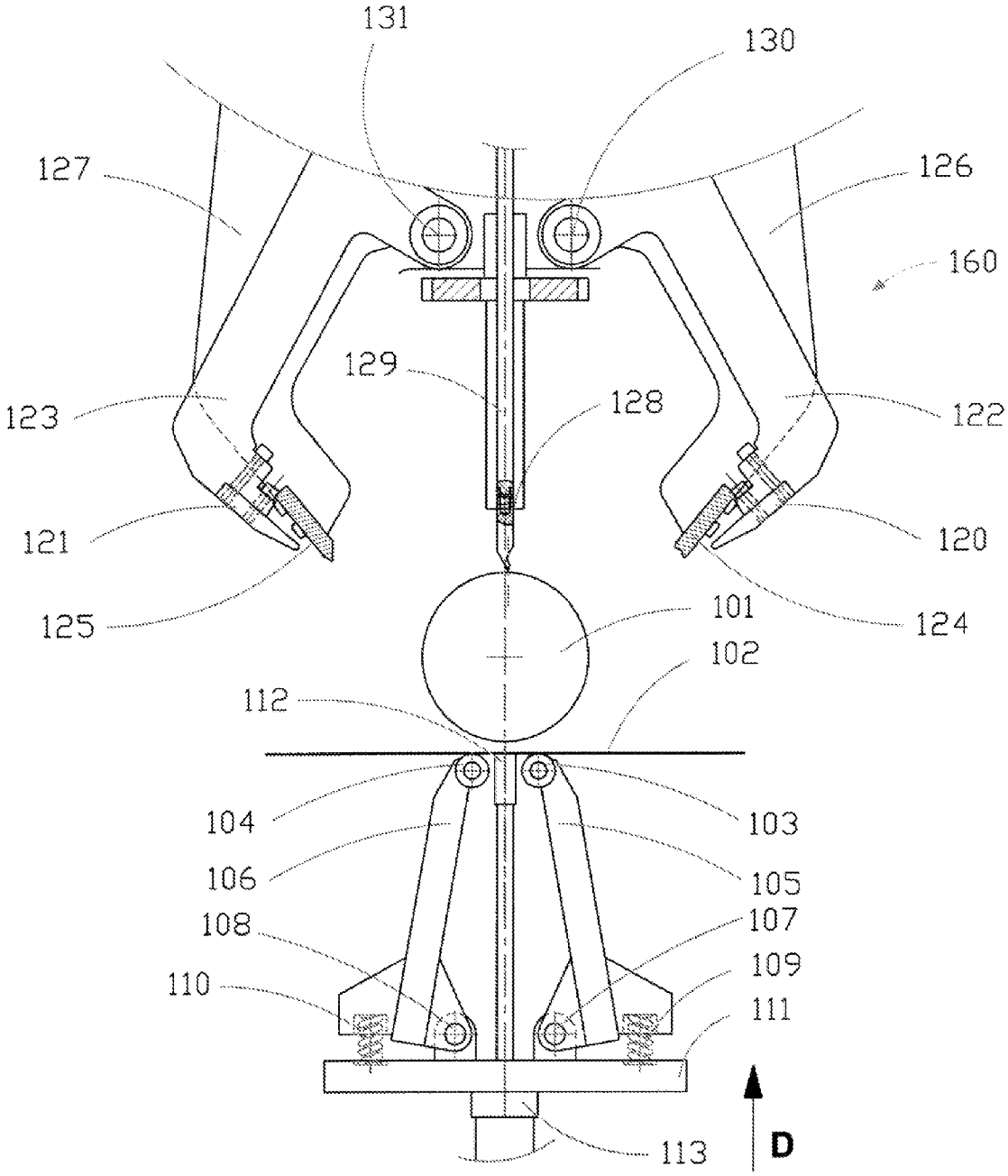
FIG. 11 is a cross-section of the apparatus of FIG. 10A showing disengaged forming rollers, gathering and forming bars in respective open positions, and the center bar in a lowered position, drawn at a smaller scale.
Figure 12:
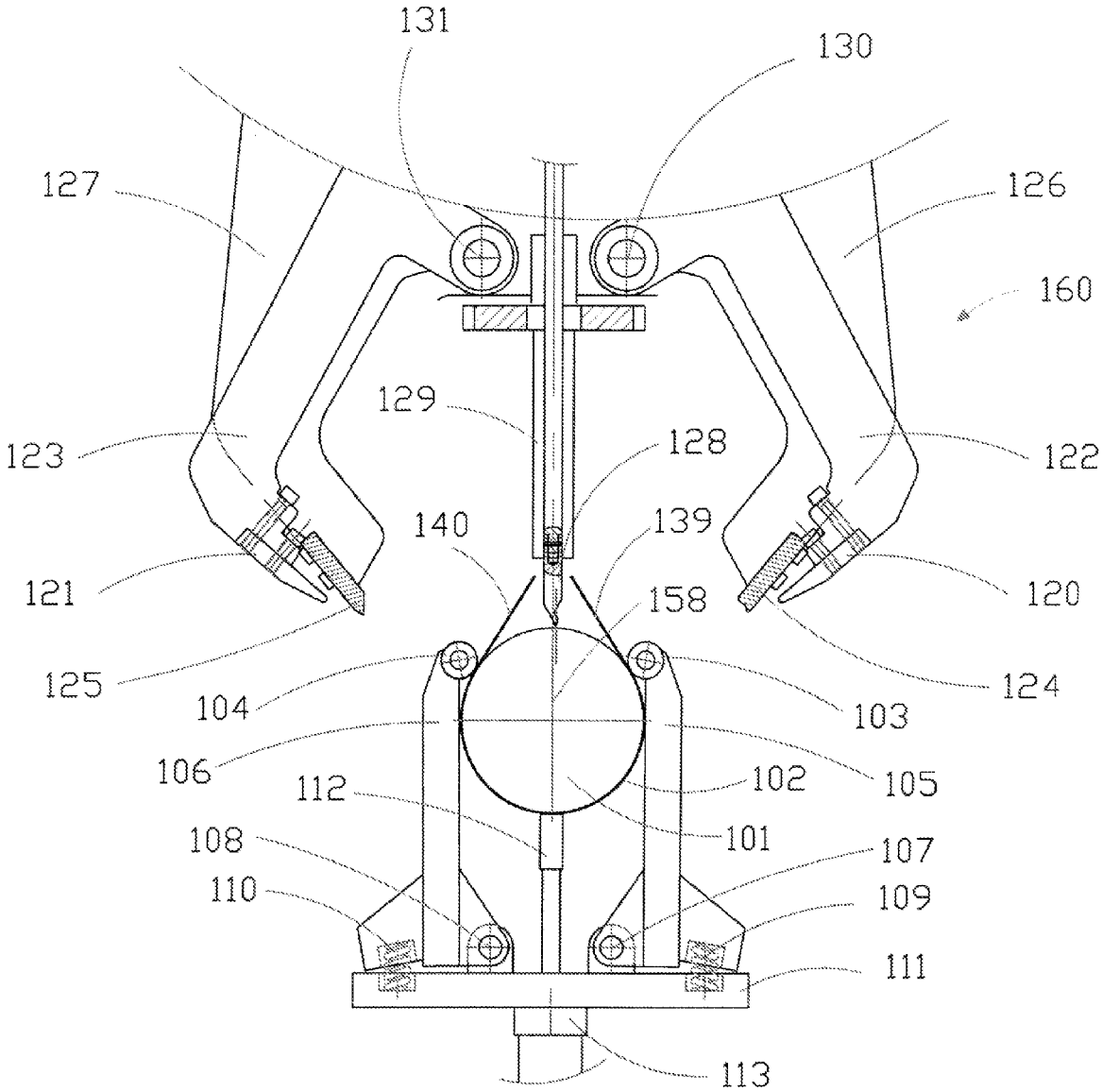
FIG. 12 is a cross-section of the apparatus of FIG. 10A showing the sheet at least partially wrapped onto the mandrel by the forming rollers.

In use, the sheet 102 is positioned on the forming rollers 103, 104 and a pressure bar 112 (FIG. 11). Preferably, a platform 111 moves upwardly (i.e., in the direction indicated by arrow "D" in FIG. 11) relative to the mandrel 101, thereby causing the sheet 102 to engage the mandrel 101 and also causing the forming rollers 103, 104 to move upwardly past the mandrel 101, simultaneously pressing the sheet against the mandrel 101 (FIG. 12). As can be seen in FIG. 12, the first and second edge portions 139, 140 are initially formed when the sheet 102 is at least partially wrapped onto the mandrel 101. Preferably, the center bar 128 is moved to its lowered position before, or as, the sheet is wrapped onto the mandrel 101, so that the center bar 128 is positioned between the first and second edge portions 139, 140.

Preferably, and as shown, for example, in FIG. 12, a pressure bar 112 moves upwardly to engage the sheet 102 and press against the sheet 102, to assist in holding the sheet 102 on the mandrel 101. As is known, the pressure bar 112 preferably engages the sheet 102 when (or shortly before) the forming rollers 103, 104 engage the sheet 102, at least partially wrapping the sheet 102 onto the mandrel 101.

Figure 13B:
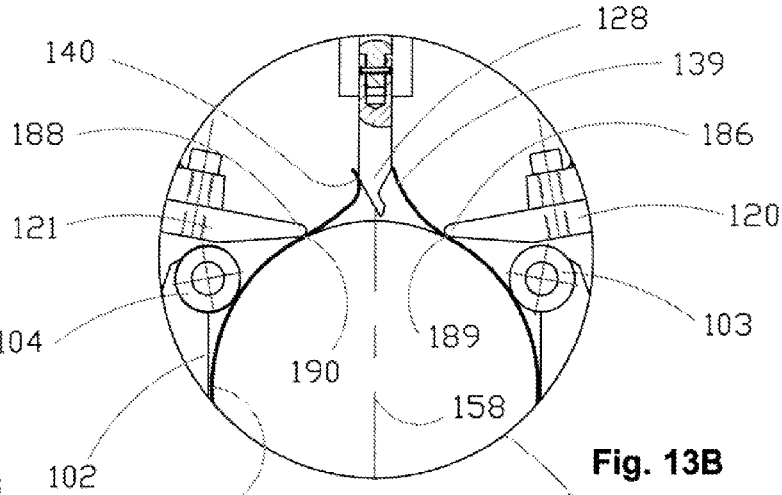
FIG. 13B is a cross-section of a portion of the apparatus of FIG. 13A, drawn at a larger scale.
Figure 13A:
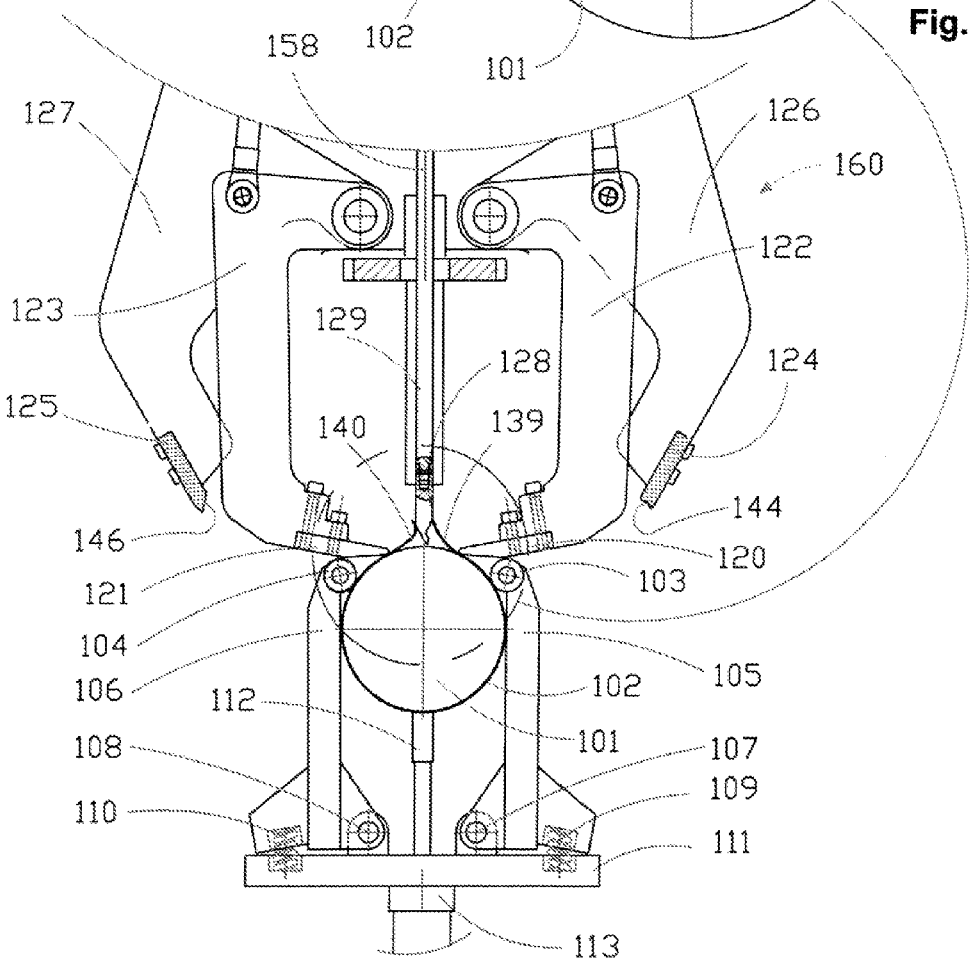
FIG. 13A is a cross-section of the apparatus of FIG. 12 showing the gathering bars engaging the sheet, drawn at a smaller scale.

As shown in FIGS. 13A and 13B, the gathering bars 120, 121 are moved to their closed position generally in opposite directions substantially transverse to the mandrel's central plane 158. Preferably, the gathering bars 120, 121 are positioned so that ends 186, 188 of the gathering bars 120, 121 engage the sheet 102 at points 189, 190 which are spaced apart relatively far from the central plane 158 (FIGS. 13A, 13B). The ends 186, 188 engage the sheet 102 and, at points 189, 190 on the sheet 102, press the sheet 102 against the mandrel 101. In this way, i.e., because the ends 186, 188 engage the sheet 102 at points 189, 190 which are spaced apart relatively far from the central plane 158, the gathering bars 120, 121 assist to provide sufficiently large edge portions 139, 140 for subsequent lockseam formation, as will be described.

Figure 14B:
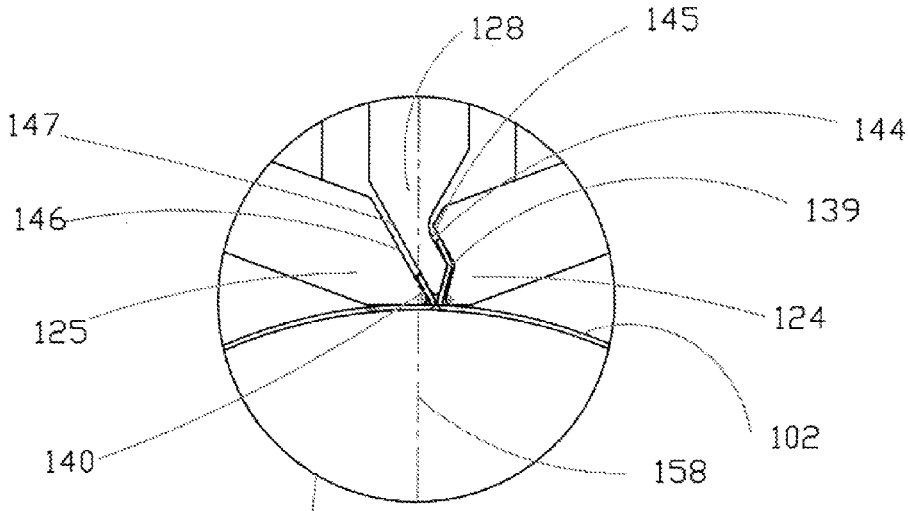
FIG. 14B is a cross-section of a portion of the apparatus of FIG. 14A, drawn at a larger scale.
Figure 14A:
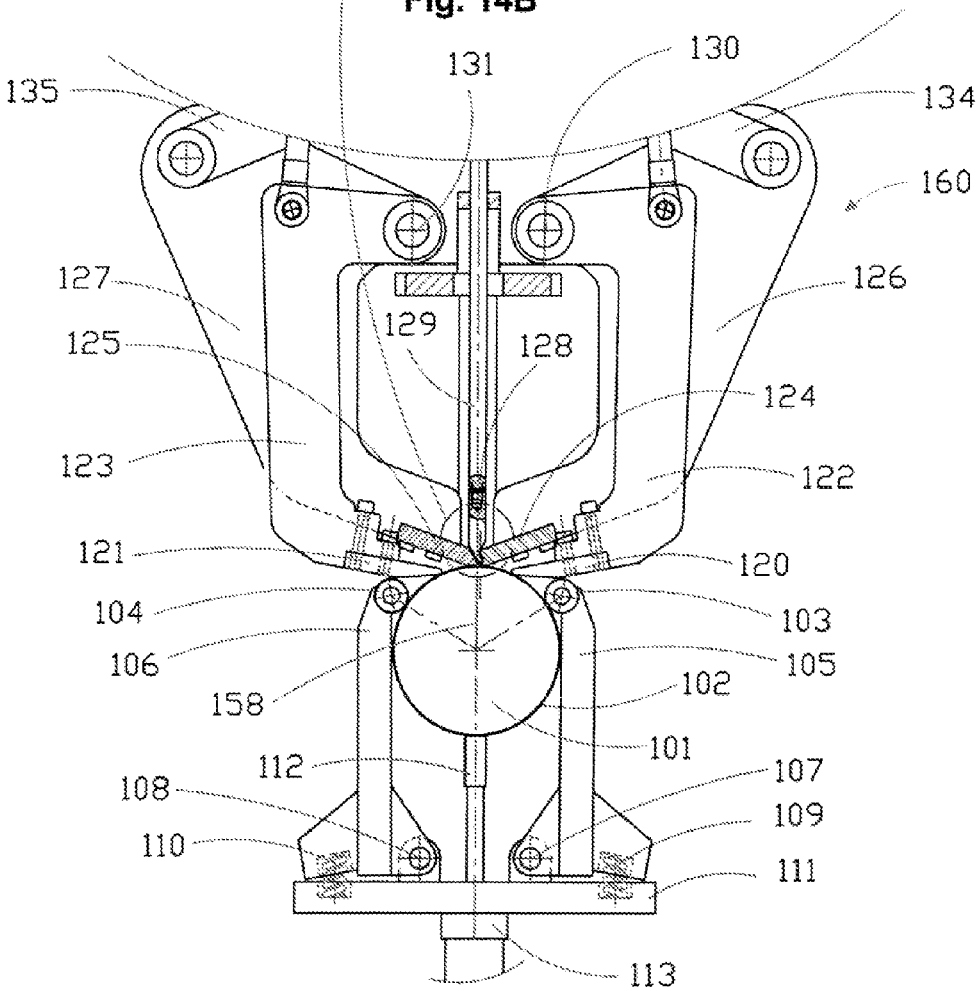
FIG. 14A is a cross-section of the apparatus of FIG. 10A showing the forming bars engaging the edge portions of the sheet, drawn at a smaller scale.

While the gathering bars 120, 121 are in the closed position (i.e., engaging the sheet, to hold the sheet 102 on the mandrel 101), the forming bars 124, 125 are moved from their open position to their closed position (FIGS. 14A, 14B). The surfaces 144, 146 of the forming bars 124, 125 engage the edge portions 139, 140 respectively, bending them toward the center bar 128. Ultimately, as the edge portions 139, 140 are pushed by the forming bars 124, 125, the edge portions 139, 140 also engage the engagement surfaces 145, 147 of the center bar 128 respectively. The engagement surfaces 145, 147 are shaped to cooperate with the surfaces 144, 146 of the forming bars 124, 125 to form the edge portions 139, 140 according to a predetermined design (FIG. 14A, 14B). The predetermined design is intended for positioning and shaping the edge portions 139, 140 optimally, so that they are readily engaged by the lockseaming rollers 118, 119 to be formed into the lockseam.

Figure 15B:
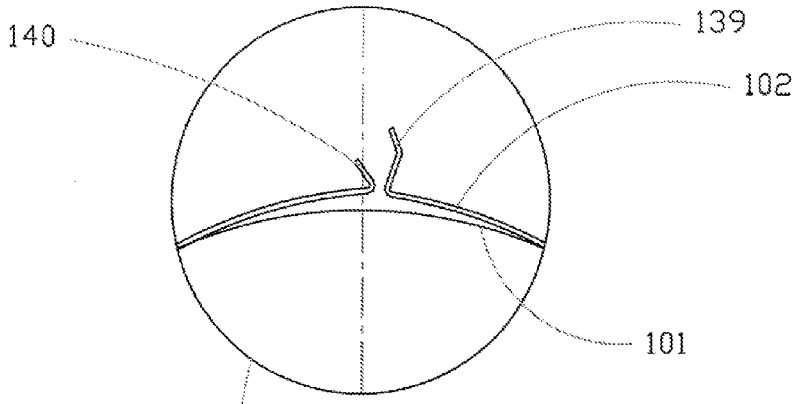
FIG. 15B is a cross-section of a portion of the apparatus of FIG. 15A, drawn at a larger scale.
Figure 15A:
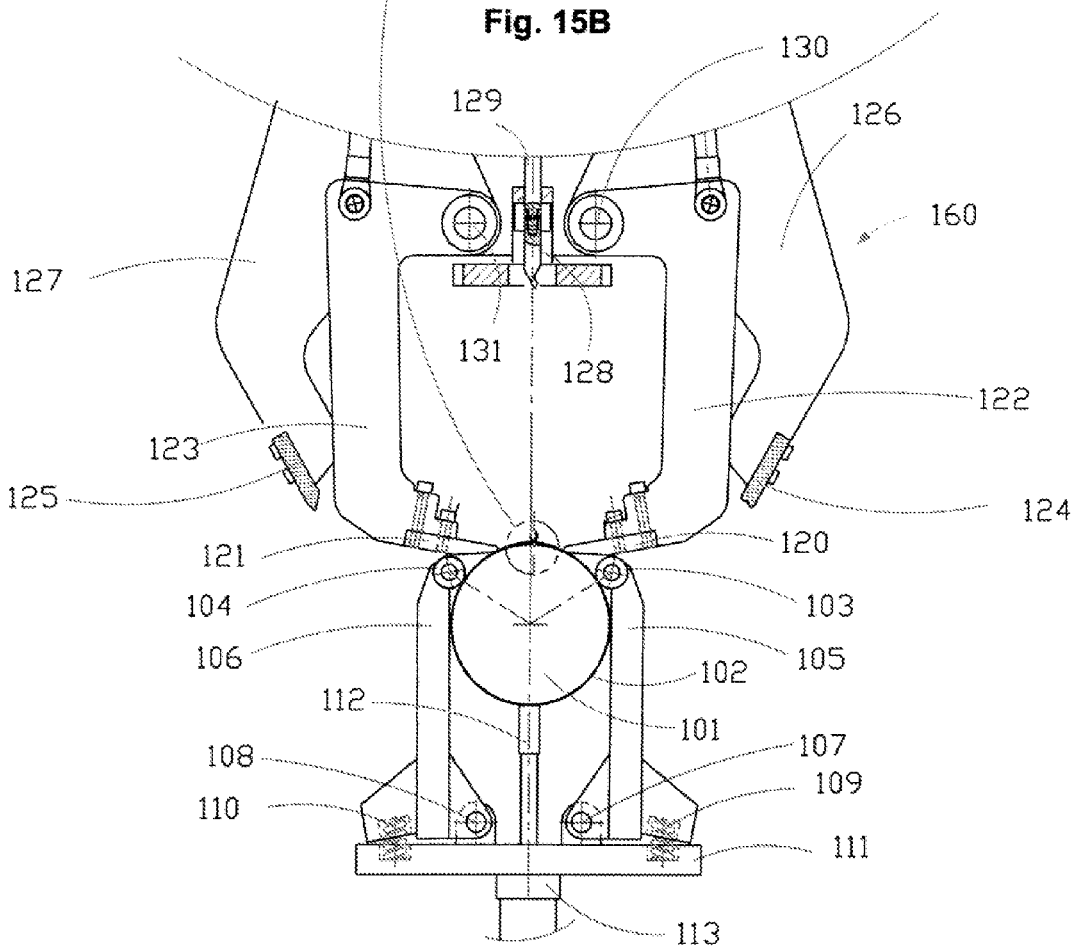
FIG. 15A is a cross-section of the apparatus of FIG. 10A showing the forming bars disengaged from the edge portions, drawn at a smaller scale.

As shown in FIGS. 15A and 15B, after the edge portions 139, 140 are formed by the forming bars 124, 125 in accordance with the predetermined design, the forming bars 124, 125 are moved to the raised position therefor. However, while the forming bars 124, 125 are so removed from engagement, the gathering bars 120, 121 remain engaged with the sheet 102, to assist in maintaining the edge portions 139, 140 in a predetermined position relative to the lockseaming rollers

118, 119, so that the lockseaming rollers 118, 119 will engage the edge portions 139, 140 properly, to form the lockseam properly (FIG. 15A).

FIGS. 16A and 16B show the lockseaming rollers 118, 119 engaging the edge portions 139, 140, to form the edge portions 139, 140 into the lockseam. As can be seen in FIGS. 16A and 16B, it is preferred that the gathering bars remain engaged with the sheet 102, assisting in holding the sheet 102 substantially stationary on the mandrel 101, while the lockseaming rollers 118, 119 engage the edge portions 139, 140.

As is known in the art, it is preferred that, the thickness of the thin wall sheet 102 is between approximately 0.03 inches (0.7 millimeters) and approximately 0.04 inches (1.0 millimeter). However, it is sometimes necessary that the shell be formed out of a sheet which is somewhat thicker, i.e., thicker than approximately 0.04 inches.

Figure 10D:
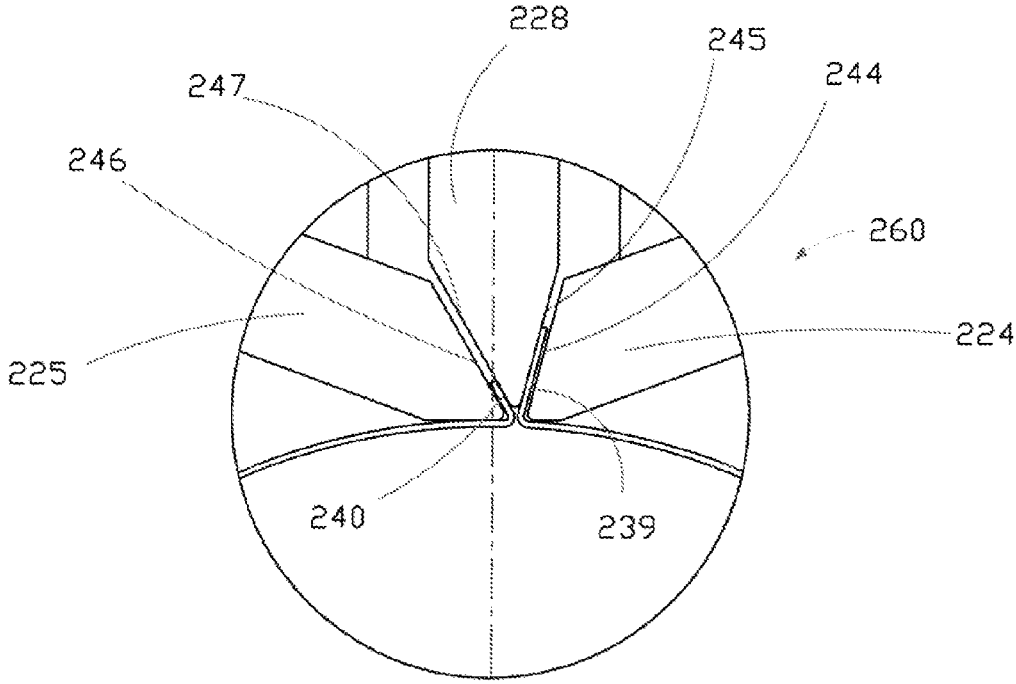
FIG. 10D is a cross-section of a portion of an alternative embodiment of the apparatus of the invention.

FIG. 10D illustrates portions of an alternative embodiment 260 of the apparatus of the invention. In FIG. 10D, a center bar 228 of the apparatus 260 preferably includes an engagement surface 245 which is substantially planar. Also, the apparatus 260 includes a forming bar 224 having a surface 244 for cooperating with the engagement surface 245 to press a first edge portion 239 into a desired shape. Preferably, the surface 244 is also substantially planar accordingly. The forming bars 224, 225 and the center bar 228 are for use where the sheet 202 is relatively thick, e.g., greater than approximately 0.04 inches (1.0 millimeter) thick. It has been determined that, where the sheet is greater than approximately 0.04 inches thick, the forming bars and the center bar preferably should be shaped so as to form the edge portions into substantially planar shapes (FIG. 10D).

Any element in a claim that does not explicitly state "means for" performing a specified function, or "step for" performing a specified function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. An apparatus for forming a thin wall sheet comprising first and second edge portions thereof into a shell with a predetermined body configuration and a lockseam in which the first and second edge portions are folded over each other, the apparatus comprising:

a mandrel extending between leading and trailing ends thereof, the mandrel being shaped to at least partially form the sheet into the predetermined body configuration;

a means for at least partially wrapping the sheet around the mandrel into the predetermined body configuration such that a leading side of the sheet is positioned adjacent to the leading end of the mandrel, a trailing side of the sheet is positioned adjacent to the trailing end of the mandrel, and the first and second edge portions are positioned proximal to each other adjacent to an uppermost top side of the mandrel;

a plurality of gathering bars for engaging the sheet to configure the first and second edge portions according to a predetermined design, a plurality of forming bars for forming the first and second edge portions into respective preselected shapes extending above the top side of the mandrel;

a plurality of lockseaming rollers for folding the first and second edge portions over each other to form the lockseam; and a center bar having first and second engagement surfaces adapted to cooperate with the forming bars to form the first and second edge portions respectively into said preselected shapes adapted for engagement by the lockseaming rollers to form the lockseam.

2. An apparatus for forming a thin wall sheet comprising first and second edge portions thereof into a shell with a predetermined body configuration and a lockseam in which the first and second edge portions are folded over each other, the apparatus comprising:

a mandrel extending between leading and trailing ends thereof, the mandrel being shaped to at least partially form the sheet into the predetermined body configuration;

a means for at least partially wrapping the sheet around the mandrel into the predetermined body configuration such that a leading side of the sheet is positioned adjacent to the leading end of the mandrel, a trailing side of the sheet is positioned adjacent to the trailing end of the mandrel, and the first and second edge portions are positioned proximal to each other adjacent to an uppermost top side of the mandrel;

a plurality of forming bars for forming the first and second edge portions into respective preselected shapes extending above the top side of the mandrel; and a center bar having first and second engagement surfaces adapted to cooperate with the forming bars to form the first and second edge portions respectively into said preselected shapes adapted for engagement by a plurality of lockseaming rollers to form the lockseam.

* * * * *